US007357155B2

(12) United States Patent
Fahrer et al.

(10) Patent No.: US 7,357,155 B2
(45) Date of Patent: Apr. 15, 2008

(54) DIFFERENT CONTOUR PAIRED BINDERS IN MULTI-LAYER FABRICS

(75) Inventors: Ernest Fahrer, Kintzheim (FR); Monique Fagon, Erstein (FR)

(73) Assignee: Albany International Corp., Albany, NY (US)

( * ) Notice: Subject to any disclaimer, the term of this patent is extended or adjusted under 35 U.S.C. 154(b) by 50 days.

(21) Appl. No.: 11/321,031

(22) Filed: Dec. 29, 2005

(65) Prior Publication Data

US 2007/0151617 A1 Jul. 5, 2007

(51) Int. Cl.

| | |
|---|---|
| ***D21F 7/08*** | (2006.01) |
| ***D21F 7/12*** | (2006.01) |
| ***D21F 1/10*** | (2006.01) |
| *D03D 25/00* | (2006.01) |

(52) U.S. Cl. ..... 139/383 A; 162/358.2; 162/900

(58) Field of Classification Search ..... 139/383 A; 162/358.2, 900

See application file for complete search history.

(56) References Cited

U.S. PATENT DOCUMENTS

| | | | | |
|---|---|---|---|---|
| 4,501,303 | A | 2/1985 | Osterberg | |
| 4,605,585 | A | 8/1986 | Johansson | |
| 5,052,448 | A * | 10/1991 | Givin | 139/383 A |
| 5,152,326 | A | 10/1992 | Vohringer | |
| 5,219,004 | A * | 6/1993 | Chiu | 139/383 A |
| 5,826,627 | A * | 10/1998 | Seabrook et al. | 139/383 A |
| 5,967,195 | A | 10/1999 | Ward | |
| 6,145,550 | A | 11/2000 | Ward | |
| 6,155,308 | A | 12/2000 | Kuji | |
| 6,202,705 | B1 * | 3/2001 | Johnson et al. | 139/383 A |
| 6,240,973 | B1 * | 6/2001 | Stone et al. | 139/383 A |
| 6,334,467 | B1 | 1/2002 | Barrett et al. | |
| 6,354,335 | B1 | 3/2002 | Taipale et al. | |
| 6,581,645 | B1 * | 6/2003 | Johnson et al. | 139/383 A |
| 6,810,917 | B2 | 11/2004 | Stone | |
| 6,854,488 | B2 * | 2/2005 | Hay et al. | 139/383 A |
| 6,883,556 | B2 * | 4/2005 | Fahrer et al. | 139/383 A |
| 6,920,902 | B2 * | 7/2005 | Majaury et al. | 139/383 A |
| 7,124,781 | B2 * | 10/2006 | Fahrer et al. | 139/383 A |
| 2002/0060039 | A1 | 5/2002 | Taipale | |
| 2004/0003860 | A1 | 1/2004 | Taipale et al. | |
| 2004/0020621 | A1 | 2/2004 | Heger et al. | |
| 2004/0154683 | A1 | 8/2004 | Majaury et al. | |
| 2004/0182464 | A1 | 9/2004 | Ward | |
| 2004/0206414 | A1 | 10/2004 | Festor | |
| 2004/0238062 | A1 | 12/2004 | Quigley et al. | |
| 2005/0067040 | A1 | 3/2005 | Quigley | |
| 2005/0121097 | A1 * | 6/2005 | Ward | 139/383 A |
| 2006/0211320 | A1 * | 9/2006 | Stone et al. | 442/205 |

FOREIGN PATENT DOCUMENTS

WO WO 2004/111333 A2 12/2004

* cited by examiner

*Primary Examiner*—Robert Muromoto
(74) *Attorney, Agent, or Firm*—Frommer Lawrence & Haug LLP; Ronald R. Santucci

(57) ABSTRACT

A multi-layer fabric which may be utilized in a papermaking process. The fabric layers are bound together by plural pairs of weft binder yarns. Each binder yarn within a pair weaves a different contour pattern and combines with the other binder yarn in that pair to form a plain weave pattern in the top layer. Each of the plural pairs is comprised of binding yarns that weave different contour patterns from the next pair.

12 Claims, 7 Drawing Sheets

DIFFERENT CONTOUR PAIRED BINDERS IN MULTI-LAYER FABRICS

BACKGROUND OF THE INVENTION

1. Field of the Invention

The present invention relates to the papermaking arts. More specifically, the present invention relates to fabrics, such as forming fabrics, for use with a paper making machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface and fiber support properties, but such design may lack the desired stability resulting in a short fabric life. By contrast, coarse mesh fabrics provide stability and long life at the expense of fiber support and the potential for marking. To minimize the design tradeoff and optimize both support and stability, multi-layer fabrics were developed. For example, in double and triple layer fabrics, the forming side is designed for sheet and fiber support while the wear side is designed for stability, void volume, and wear resistance.

Both double layer and triple layer fabrics are commonly used within the paper industry. A typical double layer fabric comprises a set of forming weft yarns (shutes) and a set of wear weft yarns interwoven by a set of warp yarns. Whereas, triple layer fabrics essentially consist of two fabrics, the forming layer and the wear layer, held together by binding yarns. For either type of fabric, the binding is extremely important to the overall integrity of the fabric. One problem with multi-layer fabrics has been relative slippage between the layers which breaks down the fabric over time. In addition, the binding yarns can disrupt the structure of the forming layer resulting in marking of the paper.

Multi-layer fabrics often incorporate a "paired binder yarn" concept in which two binder yarns act together (i.e. as a pair) to effectively weave one unbroken contour in the top surface of the fabric. References describing fabrics with paired binder yarns include U.S. Pat. No. 5,967,195 (the "Ward" patent), U.S. Pat. No. 5,826,627 (the "Seabrook" patent), and U.S. Pat. No. 4,501,303 (the "Osterberg" patent).

Those skilled in the art will appreciate that fabrics are created by weaving, and have a weave pattern which repeats in both the warp or machine direction (MD) and the weft or cross-machine direction (CD).

Multi-layer fabrics, such as triple layer fabrics, may have unacceptable resistance to internal abrasion and/or the weave may loosen (i.e. the yarns may slide from their original positions within the pattern) during use. The present invention provides a fabric which overcomes such disadvantages.

SUMMARY OF THE INVENTION

Accordingly, the present invention is a multi-layer fabric which may be usable in the forming, pressing and/or drying sections of a paper making machine.

The present invention is preferably a multi-layer papermaking fabric comprising a first layer of machine direction (MD) yarns, a second layer of MD yarns, a first system of paired cross-machine direction (CD) yarns comprising first binder yarns weaving a first contour pattern and second binder yarns weaving a second contour pattern different from the first contour pattern, and a second system of paired CD yarns comprising third binder yarns weaving a third contour pattern and fourth binder yarns weaving a fourth contour pattern different from the third contour pattern. Each pair of binder yarns is intrinsic to the first layer and binds with the second layer. The first and second systems of paired CD binder yarns weave different contour patterns.

Other aspects of the present invention include that the fabric may be a triple layer forming fabric. The first layer which comprises a first layer of MD yarns may form a forming side of the fabric and the second layer which comprises a second layer of MD yarns may form a wear side of the fabric. The binder yarns in each pair of the first and second systems may combine to weave each MD yarn in the first layer of MD yarns. The fabric may further comprise a third system of CD yarns interwoven with the first layer between pairs of the first and second systems of CD binder yarns and/or a fourth system of CD yarns interwoven with the second layer of MD yarns. At least some of the binder yarns may weave double knuckles in the second layer. The fabric may have forming side binder shute ratios of 1:1, 2:1, 3:2, 3:1, or any other shute ratio known in the art. The fabric may also have a forming side to wear side shute ratio of 1:1, 2:1, 3:2, 3:1, or any other suitable shute ratio. The MD yarns in the second layer may be a different diameter than in the first layer. At least some of the MD yarns and CD yarns may be monofilament yarns and may be one of polyamide yarns or polyester yarns. At least some of the MD yarns and CD yarns have one of a circular cross-sectional shape, a rectangular cross-sectional shape and a non-round cross-sectional shape.

For purposes of this application, cross machine direction yarns may be described as CD yarns, weft yarns, or shute yarns. The binder yarns are preferably in the cross machine direction, but may alternatively be in the machine direction.

The present invention will now be described in more complete detail with reference being made to the drawing figures, which are identified below in which corresponding components are identified by the same reference numerals.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The invention pertains to a multi-layer fabric such as a triple layer fabric which may be utilized in a papermaking process. Such multi-layer fabrics include a first (top) layer and a second (bottom) layer in which each of the first and second layers may have a system of machine-direction (MD) yarns and cross-machine direction (CD) yarns interwoven therewith. The first layer may be a paper side or forming layer upon which the cellulosic paper/fiber slurry is deposited during the papermaking process and the second layer may be a machine side or wear side layer. The fabric layers are bound together by plural pairs of weft binder yarns. Each binder yarn within a pair weaves a different contour pattern and combines with the other binder yarn in that pair to form a plain weave pattern in the top layer (i.e. a sheet support binder (SSB) sequence) or, alternatively, a non-plain weave pattern. Each pair is comprised of binding yarns that weave different contour patterns from the next pair. For example, the fabric may be a triple layer forming fabric having two SSB pairs wherein the binder yarns in the first pair weave respectively two and three plain weave contours in the top layer and the second pair weaves four and one plain weave contours respectively.

Multi-layer fabrics have been previously proposed which incorporate paired binder yarns where the binder yarns in the pair have different contour patterns. However, previous fabrics have not included plural different binder yarn pairings where not only are the contour patterns different within each pair, but the contour patterns are also different between the pairs. This additional feature of the present invention allows for greater flexibility in designing fabrics with desired characteristics.

Advantages of the present invention include a monoplane surface for reduced surface marking and improved paper smoothness. Fabrics according to the present invention have good stability characteristics for running on high speed papermaking machines. The present fabrics also have a high number of contact points resulting in good paper retention.

Figure 1:
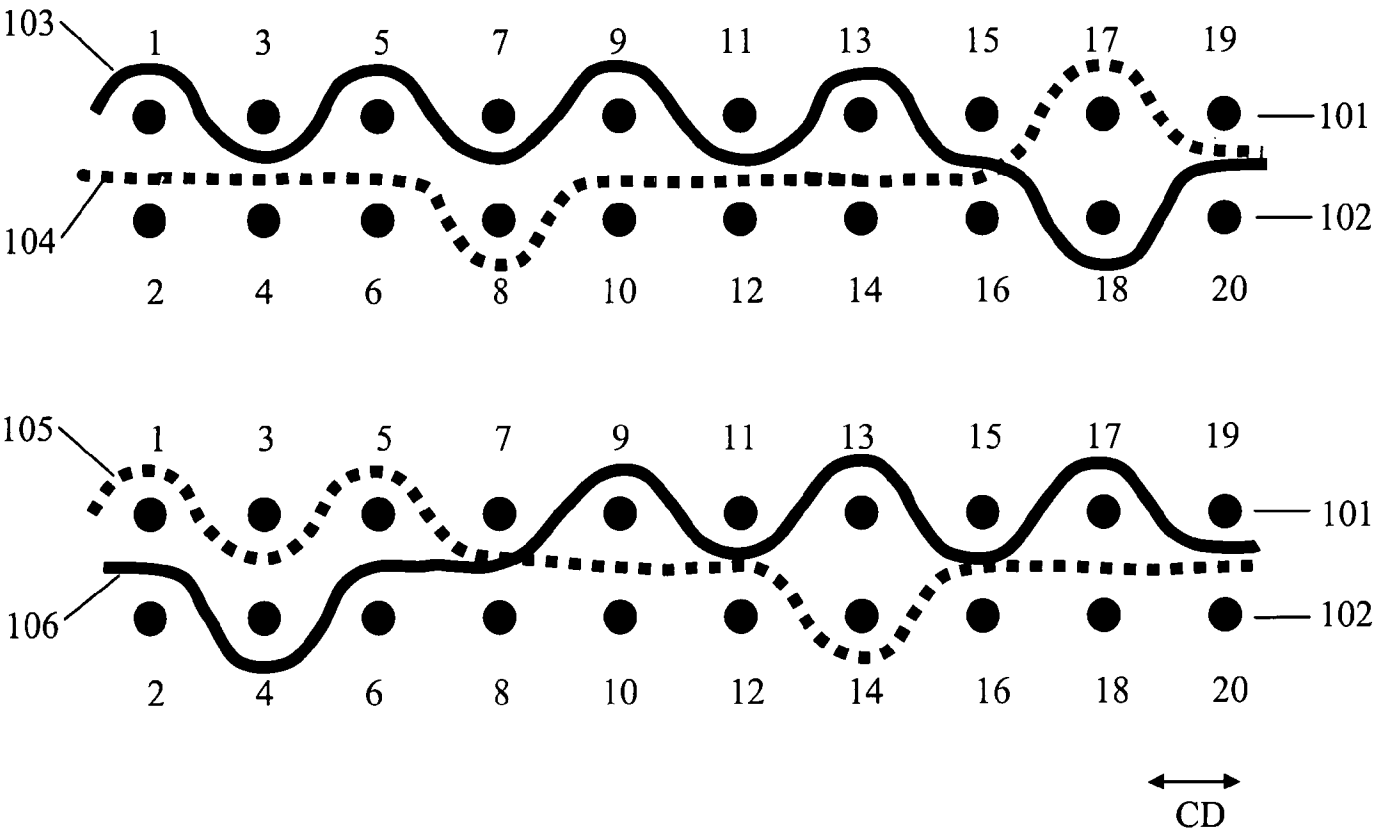
FIG. 1 shows schematic cross-sectional views of two different pairs of binder yarn contours for an exemplary fabric according to the present invention.

FIG. 1 shows schematic cross-sectional views of two different pairs of binder yarn contours for an exemplary fabric according to the present invention. In FIG. 1, the plural contours of two binder yarn pairs are shown as they weave with the MD yarns in the top (forming) layer 101 and bind the bottom (wear side) layer 102. In the present fabric, the first pair of binder yarns 103, 104 alternates with the second pair of binder yarns 105, 106; with intrinsic shute yarns (not shown) woven between each pair. As explained below, this example fabric is referred to as having a 4+1, 2+3 contour pattern. The numbers indicate the number of knuckles made by a binder yarn in the top layer. For purposes of this application, a knuckle is formed when a CD yarn passes over one or more MD yarns on the outer surface of the fabric. The plus indicates the presence of a following binder yarn; i.e. the other binder yarn of the pair.

For the first binder pair of the fabric shown in FIG. 1 the first binder yarn 103 starts in the top layer 101 and passes over MD yarn 1, under MD yarn 3, over MD yarn 5, under MD yarn 7, over MD yarn 9, under MD yarn 11, over MD yarn 13, and under MD yarn 15 where it crosses with the second binder yarn 104. In this manner, the first binder yarn forms four knuckles in the top layer. The first binder yarn then traverses to the bottom layer 102 and binds with MD yarn 18 before traversing back to the top layer where it crosses with the second binder yarn 102 under MD yarn 19 to complete one repeat of the weave pattern. Hence, the first binder yarn is designated as having a contour pattern of 4. The second binder yarn 104 begins the pattern in the bottom layer 102 where it binds with MD yarn 8 before traversing to the top layer 101 under MD yarn 15. The second binder yarn 104 passes over MD yarn 17 to form its only knuckle in the top layer before returning to the bottom layer under MD yarn 19 to complete the weave pattern repeat. Hence, the second binder yarn is designated as having a contour pattern of 1 and this first pair is identified by its binder yarn patterns as 4+1. Note the first and second binder yarns' contours combine to weave every other MD yarn in the top layer, thereby producing a plain weave pattern in the top layer. Also note that in this case the binder pair is intrinsic to the top layer, but simply binds the bottom layer.

Similarly for the second binder pair, the third binder yarn 105 starts in the top layer 101 and passes over MD yarn 1, under MD yarn 3, over MD yarn 5, and under MD yarn 7 where it crosses with the fourth binder yarn 106. In this manner, the third binder yarn forms two knuckles in the top layer. The third binder yarn then traverses to the bottom layer 102 and binds with MD yarn 14 before traversing back to the top layer where it crosses with the fourth binder yarn 106 under MD yarn 19 to complete one repeat of the weave pattern. The fourth binder yarn 106 begins the pattern in the bottom layer 102 where it binds with MD yarn 4 before traversing to the top layer 101 under MD yarn 7. The fourth binder yarn 106 passes over MD yarn 9, under MD yarn 11, over MD yarn 13, under MD yarn 15, and over MD yarn 17 to form three knuckles in the top layer before returning to the bottom layer under MD yarn 19 to complete the weave pattern repeat. Hence, the second binder pair is identified by its binder yarn contour patterns as 2+3. Accordingly, this example fabric is referred to as having a 4+1, 2+3 contour pattern.

Numerous permutations of binder yarn contours are encompassed by the present invention. For example, fabrics according to the present invention may also have 2+3, 1+4; 3+2, 1+4; 2+3, 4+1; and 3+2, 4+1 contour patterns. Of course, these contour patterns are simply representative examples of the invention and many additional permutations as would be apparent to one skilled in art are possible.

Figure 2:
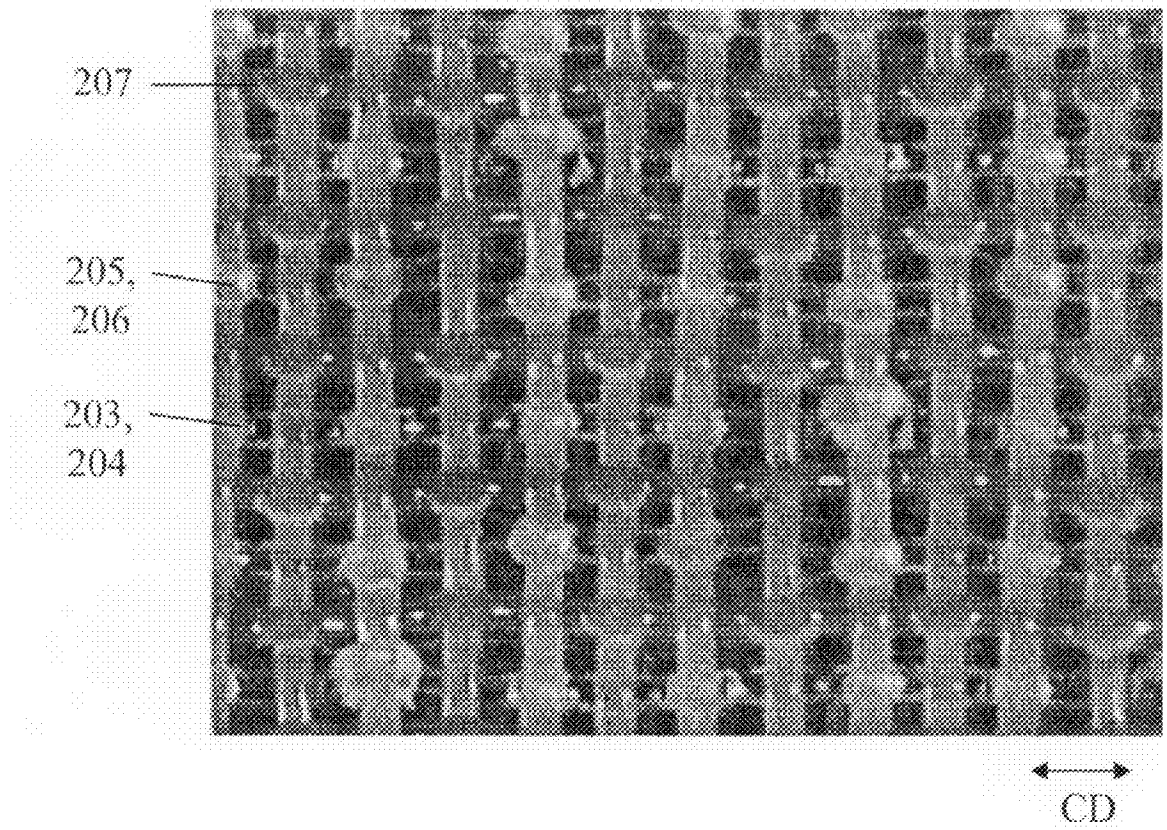
FIG. 2 is a forming surface view of a fabric according to an embodiment of the present invention.

FIG. 2 is a forming surface view of an exemplary fabric according to the present invention. The darker horizontal yarns are intrinsic forming layer shutes 207 woven in a plain weave pattern. Alternating between these shutes are pairs of 2+3 binder yarns (205,206) and 4+1 binder yarns (203,204). Accordingly, this exemplary fabric has a 1:1 forming side shute to binder pair ratio.

Figure 3:
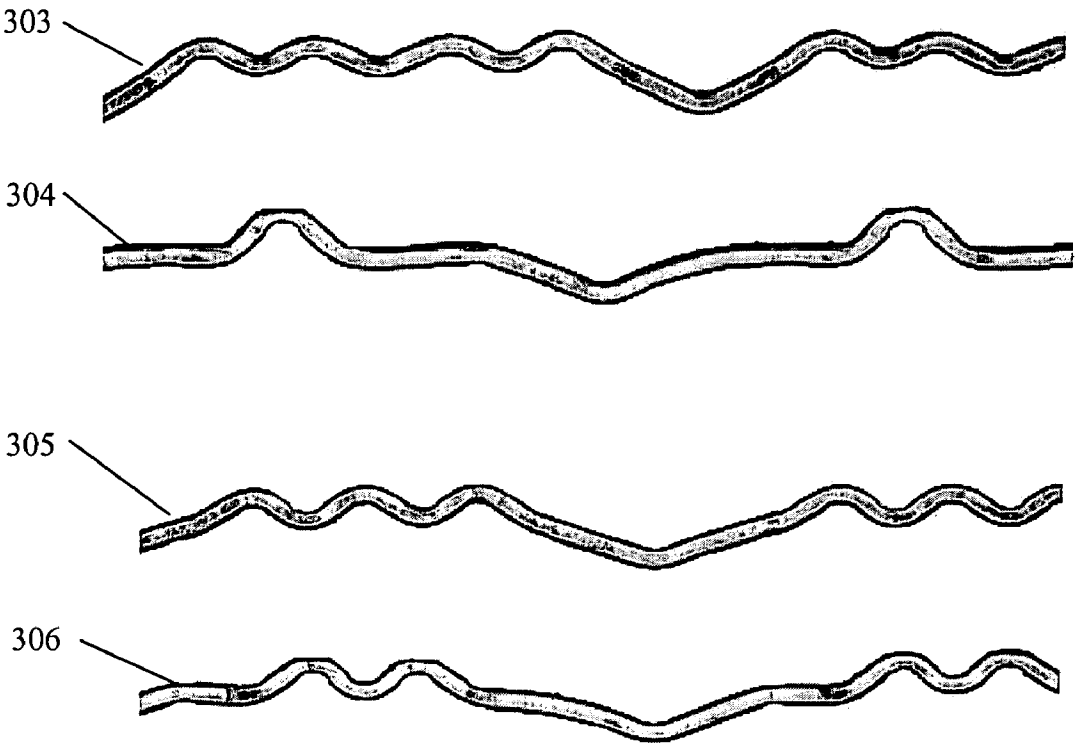
FIG. 3 shows contour profile views of two different pairs of binder yarns from a fabric according to the present invention.
Figure 4:
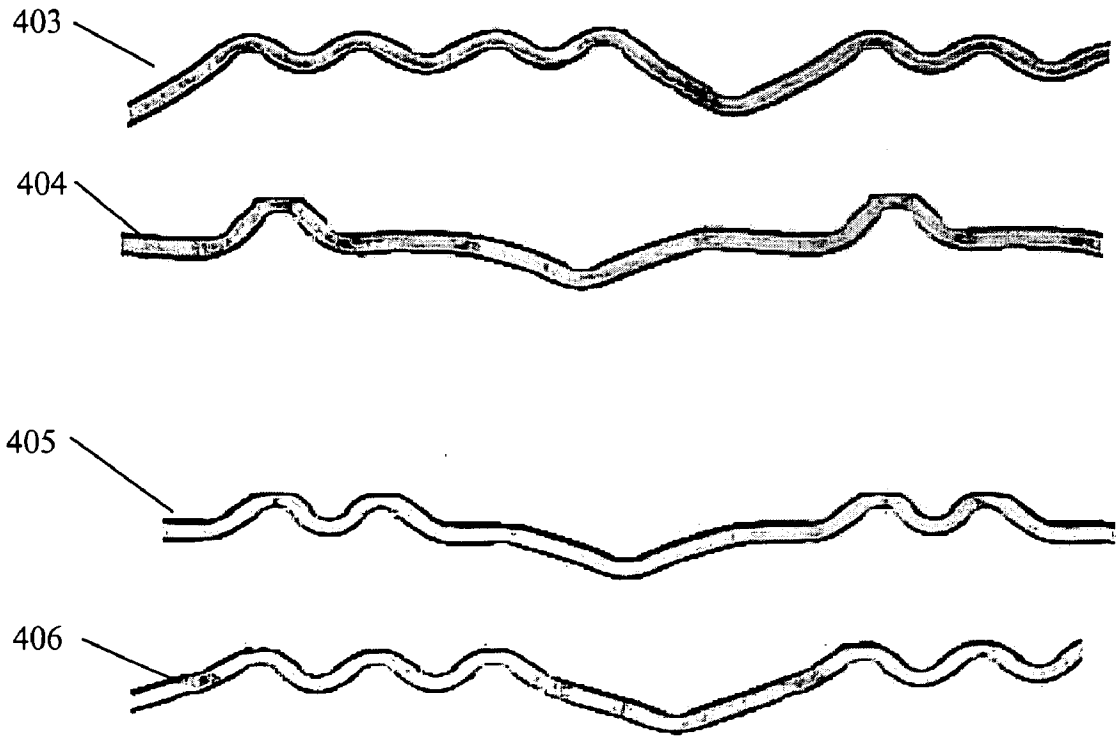
FIG. 4 shows contour profile views of two different pairs of binder yarn from another fabric according to the present invention.

FIGS. 3 and 4 are profile contour views of two different pairs of binder yarns extracted from two fabrics produced in accordance with the teaching of the present invention. In FIG. 3, the first pair comprises a first binder yarn 303 and a second binder yarn 304 to produce a 4+1 contour pattern. Whereas, the second pair has a third binder yarn 305 and a fourth binder yarn 306 that form a 3+2 contour pattern. Likewise in FIG. 4, the first pair comprises a first binder yarn 403 and a second binder yarn 404 to produce a 4+1 contour pattern; while the second pair has a third binder yarn 405 and a fourth binder yarn 406 that form a 2+3 contour pattern. In this manner, the binder yarns in FIG. 3 are from a 4+1, 3+2 fabric and FIG. 4 are from a 4+1, 2+3 fabric.

Figure 5:
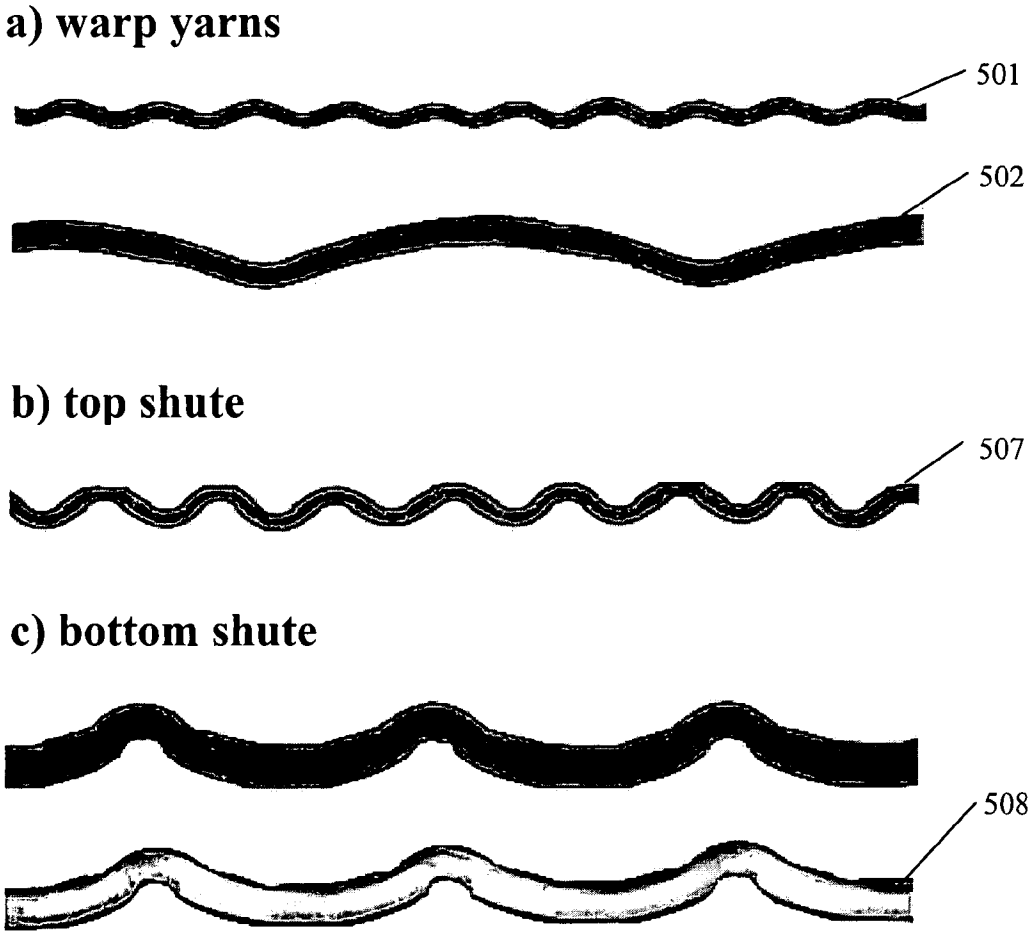
FIG. 5 shows contour profile views of the a) warp yarns, b) top shute, and c) bottom shute from a fabric according to the present invention.

FIG. 5 shows contour profile views of the a) warp yarns, b) top shute, and c) bottom shute from a fabric according to the present invention. The contour profile of the top layer warp yarn 501 indicates a plain weave surface pattern. The bottom layer warp yarn 502 is often a larger diameter than the top layer warp yarn in order to improve the wear resistance of the fabric. The top shute 507 also reflects the plain weave surface pattern. The bottom shute 508 is also typically a larger diameter for wear resistance. The bottom shute may also form long floats or runners on the bottom surface of the fabric. The top and bottom shutes are intrinsic to their respective layers and are woven between the pairs of binder yarns. The shute ratio of the present fabrics can be varied by adjusting the number of top and bottom shutes, or by not having any functional top or bottom shutes.

Figure 6:
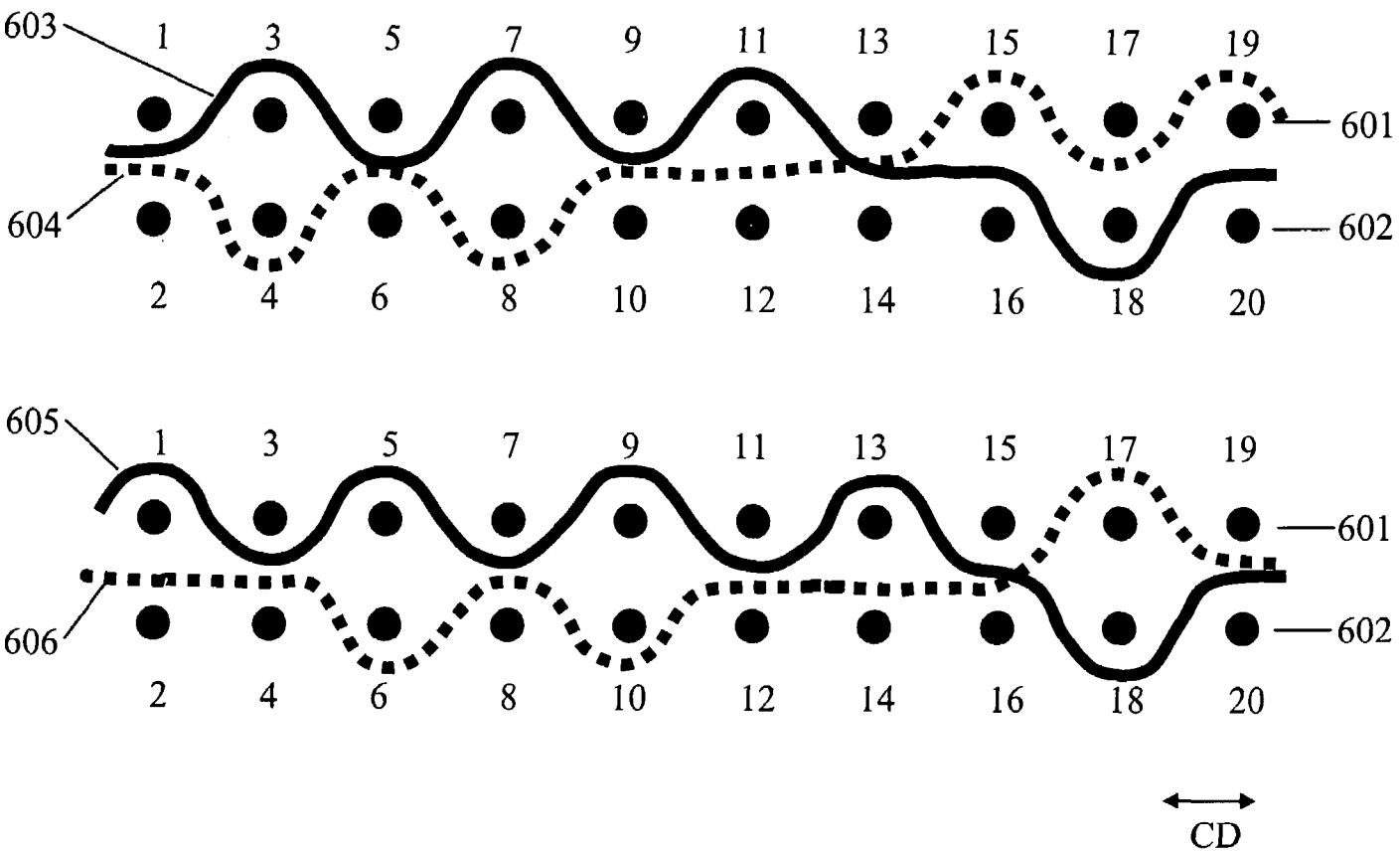
FIG. 6 shows schematic cross-sectional views of two different pairs of binder yarn contours for a second exemplary fabric according to the present invention.

FIG. 6 shows schematic cross-sectional views of two different pairs of binder yarn contours for a second exemplary fabric according to the present invention. In FIG. 6, the plural contours of two binder yarn pairs are shown as they weave with the MD yarns in the top (forming) layer 601 and bind the bottom (wear side) layer 602. In the present fabric, the first pair of binder yarns 603, 604 alternates with the second pair of binder yarns 605, 606; with intrinsic shute yarns (not shown) woven between each pair. This second example fabric has a 3+2, 4+1 contour pattern. Note that in this fabric, one of the binder yarns in each pair forms a double knuckle contour (also referred to as a double lock) on the wear side surface of the fabric. Specifically, binder yarn 604 binds with MD yarns 4 and 8 in the bottom layer 602 and binder yarn 606 binds with MD yarns 6 and 10 in the bottom layer 602 to each form a double knuckle in the wear side surface.

Figure 7:
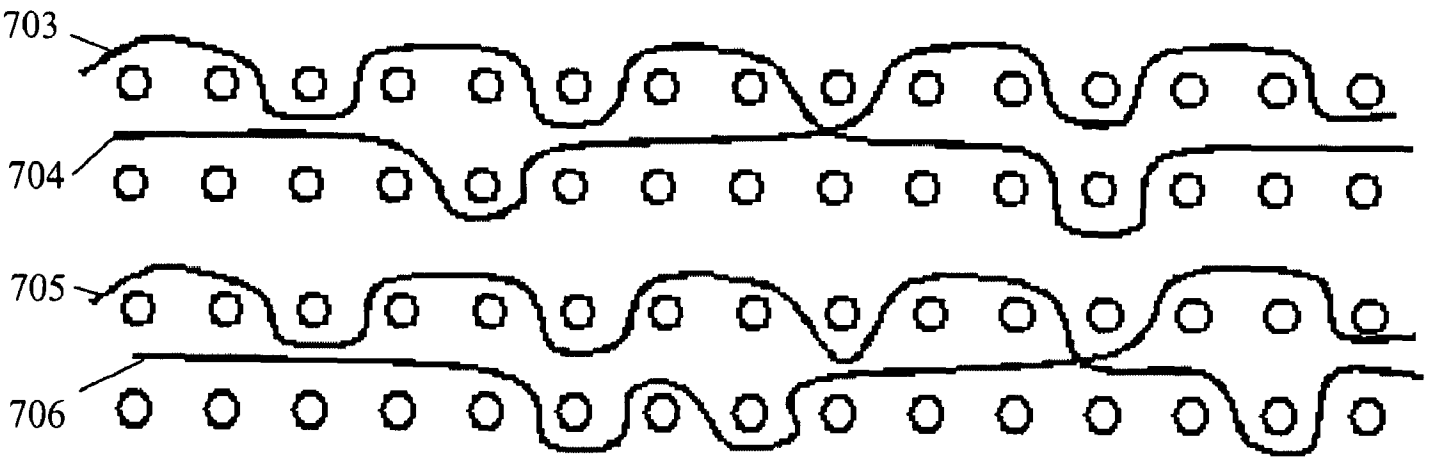
FIG. 7 shows schematic cross-sectional views of two different pairs of binder yarn contours for a third exemplary fabric according to the present invention.

Another aspect of the present invention includes patterns that do not produce a plain weave pattern on the paper forming surface of the fabric. For example, FIG. 7 shows schematic cross-sectional views of two different pairs of binder yarn contours (first pair 703, 704 and second pair 705, 706) which produce a three-shed pattern on the paper forming surface. Like the example fabric shown in FIG. 6, the fabric shown in FIG. 7 also has a 3+2, 4+1 contour pattern, but its pattern repeats every 15 frames rather than every 10 frames. Accordingly, the fabric in FIG. 7 requires a 30 harness loom to weave rather than a 20 harness loom as required by the fabric in FIG. 6. To produce the three-shed pattern, each binder yarn pair weaves beneath every third MD yarn in the top layer. Also note the fourth binder yarn 706 forms a double knuckle contour in the bottom layer. Many other non-plain weave surface patterns are encompassed by the invention, including patterns which require looms having a large number of harnesses.

As mentioned previously, the present invention is a derivative of the sheet support binder (SSB) concept in which the binder yarns are typically part of the structure supporting the fabric. Commonly, these binder yarns are paired weft binder yarns intrinsic to the forming layer and simply bind with the wear side layer, although these binder yarns may also be intrinsic to the wear side layer. In a preferred embodiment of the present invention, the binder yarns combine to produce a plain weave pattern with the topside MD yarns and are therefore intrinsic to the top layer.

Other aspects of the present invention include that the pattern may have forming side binder shute ratios of 1:1, 2:1, 3:2, 3:1, or any other shute ratio known in the art. The forming side binder shute ratio is defined herein as being the ratio of forming side shutes (or regular CD yarns) to pairs of binder yarns in the forming layer of the fabric; wherein each pair of binder yarns counts as a single shute. The fabric may also have a forming side to wear side shute ratio of 1:1, 2:1, 3:2, 3:1, or any other suitable shute ratio. Each of the binding yarns may simply act to bind the wear side or it can weave integrally with the wear side pattern. The binding yarns may be made of the same or different materials and be of different diameters. The binder yarns may also form double knuckle contours on the wear side surface of the fabric. One or both binder yarns in each pair may be intrinsic to the structure of the wear side layer. The binder yarns may run in the cross machine direction or alternatively in the machine direction. The binder yarn pairs may form a plain weave pattern or a non-plain weave pattern in the top layer. Fabrics according to the present invention may be woven on various size looms, including but not limited to 20, 30, 40, and 48 harness looms. Note, these examples are simply representative examples of the invention and are not meant to limit the invention.

The fabric according to the present invention may comprise monofilament yarns. The yarns may be polyester monofilament and/or some may be polyester or polyamide. In addition, the fabric may comprise multifilament yarns, plied or mono-filament yarns, bi-component yarns, and/or any other suitable yarns known in the art. The yarns may have a circular cross-sectional shape with one or more different diameters. Further, in addition to a circular cross-sectional shape, one or more of the yarns may have other cross-sectional shapes such as a rectangular cross-sectional shape or another non-round cross-sectional shape.

Additionally, although the present invention has been described as usable for the papermaking process, the present invention is not so limited. That is, the present fabric may be utilized for other uses.

Modifications to the above would be obvious to those of ordinary skill in the art, but would not bring the invention so modified beyond the scope of the present invention. The claims to follow should be construed to cover such situations.

What is claimed is:

1. A papermaker's fabric, comprising:

a first layer of machine direction (MD) yarns;

a second layer of MD yarns;

a first system of paired cross-machine direction (CD) yarns comprising first binder yarns weaving a first contour pattern and second binder yarns weaving a second contour pattern different from the first contour pattern;

a second system of paired CD yarns comprising third binder yarns weaving a third contour pattern and fourth binder yarns weaving a fourth contour pattern different from the third contour pattern;

wherein the paired CD yarns of the first and second systems are each intrinsic to the first layer and each binds with the second layer; and wherein the first and second systems of paired CD yarns weave different contour patterns.

2. The papermaker's fabric according to claim 1, wherein the fabric is a weft-bound triple layer forming fabric.

3. The papermaker's fabric according to claim 1, wherein the first layer of MD yarns forms a forming side of the fabric and the second layer of MD yarns forms a wear side of the fabric.

4. The papermaker's fabric according to claim 1, further comprising a third system of CD yarns interwoven with the first layer of MD yarns between pairs of the first and second systems of binder yarns.

5. The papermaker's fabric according to claim 1, further comprising a fourth system of CD yarns interwoven with the second layer of MD yarns.

6. The papermaker's fabric according to claim 1, wherein the binder yarns in each pair of the first and second systems combine to weave each MD yarn in the first layer.

7. The papermaker's fabric according to claim 1, wherein at least some of the binder yarns weave double knuckles in the second layer.

8. The papermaker's fabric according to claim 1, wherein at least some of the MD yarns and CD yarns are monofilament yarns.

9. The fabric according to claim 1, wherein at least some of the MD yarns and CD yarns are one of polyamide yarns or polyester yarns.

10. The fabric according to claim 1, wherein at least some of the MD yarns and CD yarns have one of a circular cross-sectional shape, a rectangular cross-sectional shape and a non-round cross-sectional shape.

11. A papermaker's fabric, comprising:

a first layer of cross-machine direction (CD) yarns;

a second layer of CD yarns;

a first system of paired machine direction (MD) yarns comprising first binder yarns weaving a first contour pattern and second binder yarns weaving a second contour pattern different from the first contour pattern;

a second system of paired MD yarns comprising third binder yarns weaving a third contour pattern and fourth binder yarns weaving a fourth contour pattern different from the third contour pattern;

wherein the paired MD yarns of the first and second systems are each intrinsic to the first layer and each binds with the second layer; and wherein the first and second systems of paired MD yarns weave different contour patterns.

12. The papermaker's fabric according to claim 11, wherein the fabric is a warp-bound triple layer forming fabric.

* * * * *